US007293616B2

(12) United States Patent
Tulloch

(10) Patent No.: US 7,293,616 B2
(45) Date of Patent: Nov. 13, 2007

(54) EXPANDABLE BIT

(75) Inventor: Rory McCrae Tulloch, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 11 days.

(21) Appl. No.: 10/258,555

(22) PCT Filed: Apr. 24, 2001

(86) PCT No.: PCT/GB01/01814

§ 371 (c)(1),
(2), (4) Date: Jun. 5, 2003

(87) PCT Pub. No.: WO01/81708

PCT Pub. Date: Nov. 1, 2001

(65) Prior Publication Data

US 2003/0183424 A1 Oct. 2, 2003

(30) Foreign Application Priority Data

Apr. 25, 2000 (GB) ..... 0009834.3

(51) Int. Cl.
*E21B 10/32* (2006.01)
*E21B 10/62* (2006.01)

(52) U.S. Cl. ..... 175/269; 175/267; 175/383; 175/384

(58) Field of Classification Search ..... 175/269, 175/264, 267, 271, 286, 263, 266, 279, 273, 175/274, 292, 383, 384
See application file for complete search history.

(56) References Cited

U.S. PATENT DOCUMENTS 1,494,274 A * 5/1924 Morgan ..... 175/263
2,060,352 A * 11/1936 Stokes ..... 175/268
2,599,060 A * 6/1952 Kammerer ..... 175/290
2,743,087 A * 4/1956 Layne et al. ..... 175/285
2,814,463 A * 11/1957 Kammerer, Jr. ..... 175/267
3,126,065 A * 3/1964 Chadderdon ..... 175/269
3,536,150 A * 10/1970 Stebley ..... 175/263
3,575,245 A * 4/1971 Cordary et al. ..... 175/268
3,934,660 A * 1/1976 Nelson ..... 175/102
4,031,972 A 6/1977 Burg (Continued)

FOREIGN PATENT DOCUMENTS

GB 2275067 8/1994

(Continued)

OTHER PUBLICATIONS

PCT International Search Report dated Aug. 13, 2001, for application serial No. PCT/GB01/01814.

*Primary Examiner*—David Bagnell
*Assistant Examiner*—Giovanna M Collins
(74) *Attorney, Agent, or Firm*—Patterson & Sheridan LLP

(57) ABSTRACT

An expandable drill bit for use with earth drilling equipment. The bit includes arms held in a closed position, so that the bit may be inserted through casing or a small bore hole. The arms are expandable to create an expanded drill bit having a crown profile common to a solid crown bit. The arrangement of the arms provides a short gauge length so that the expanded bit is steerable downhole. Embodiments of the expandable drill bit are detailed to show mechanisms for actuating the arms between the open and closed positions.

24 Claims, 5 Drawing Sheets

U.S. PATENT DOCUMENTS

| | | | | |
|---|---|---|---|---|
| 4,081,042 | A | 3/1978 | Johnson et al. | |
| 4,354,559 | A * | 10/1982 | Johnson | 175/71 |
| 4,565,252 | A | 1/1986 | Campbell et al. | |
| 4,589,504 | A * | 5/1986 | Simpson | 175/267 |
| 5,090,480 | A * | 2/1992 | Pittard et al. | 166/298 |
| 5,141,063 | A | 8/1992 | Quesenbury | |
| 5,361,859 | A * | 11/1994 | Tibbitts | 175/286 |
| 6,009,961 | A | 1/2000 | Pietrobelli et al. | |
| 6,076,618 | A | 6/2000 | Asberg | |
| 6,338,390 | B1 * | 1/2002 | Tibbitts | 175/56 |
| 6,427,788 | B1 | 8/2002 | Rauchenstein | |
| 6,607,046 | B1 | 8/2003 | Betts et al. | |
| 2002/0043404 | A1 * | 4/2002 | Trueman et al. | 175/45 |
| 2004/0124011 | A1 * | 7/2004 | Gledhill et al. | 175/57 |

FOREIGN PATENT DOCUMENTS

| | | | |
|---|---|---|---|
| GB | 2320270 | | 6/1998 |
| SU | 501139 | * | 12/1973 |
| SU | 1740602 A1 | * | 6/1992 |

* cited by examiner

EXPANDABLE BIT

The present invention relates to a drill bit primarily for use in creating well bores, but which can also be used inside liner casing to remove build-ups of scale.

The drilling of wells for oil and gas production is achieved using a string of drill pipe with a drill bit mounted at the lowermost end, which is rotated from the surface into the earth. The drill bit is generally comprised of a body which can be secured to a work string at its uppermost end, ie the shank, and a crown. The crown is essentially the area of the bit which carries the cutting means which drill the earth to create the bore, and is comprised of an uppermost chamfer, an annular gauge and tapered flank upon which the cutting means are mounted, and a lowermost nose which engages with the bottom of the hole.

After a section of well has been bored, it is common practice to insert joints of heavy steel tubing, commonly known as casing, into the bore to act as a liner to structurally support the walls of the well bore from collapse.

Typically, the casing has a smaller outside diameter than the drill bit which created the bore into which the casing is to be passed.

The standard method used to drill well bores is to drill each section with consecutively smaller bits and then line the well bores with proportionately smaller casing. However, a standard practice also exists with regard to using a drilling underreamer positioned behind a standard drill bit acting as a pilot to cut the inner cross-sectional area of the well bore. Conventional underreamers include a number of expandable arms which can move between a withdrawn or closed configuration and an expanded or open configuration. The pilot bit and underreamer can be passed through the casing when the underreamer is closed. After passing through the casing the underreamer can be opened in order to enlargen the rat-hole below the casing shoe, and hence create a wellbore equal to or larger than the original drilled hole. In recent years bi-centre bits, which have offset cutting members mounted at irregular intervals around the crown of the bit, have been developed as an alternative to underreamers. However, these bits are unstable due to their irregular structure and tend to be more difficult to control for directional purposes than ordinary drill bits and may not drill the expected swept diameter of the offset pads which ream the pilot hole created by the crown.

It will be appreciated that it is not always desirable, or in fact possible to drill a truly straight well bore. For example it may be desirable to control the direction of the drilling procedure in order to reach a particular area, or to create a horizontal or expanded well once the correct depth of bore has been drilled. In such instances, it is common to use steerable drilling apparatus. Standard steerable drilling apparatus is generally comprised of a downhole motor which can drive or rotate a drill bit positioned at the lowermost end of the motor. Typically, the downhole motor has a bent housing with an angle of 0.5 to 2.0 degrees above the bearing section of the motor about 6-10 feet behind the bit. This can be used to steer the assembly when the drill-string is not being rotated and allows the direction of the well-bore to be controlled in response to changing downhole conditions. In order to steer the drill bit in a desired direction, rotation of the drill string is stopped which allows the motor to incline the drill bit to tilt in the desired direction. As a result, a curved section of the bore can be formed. At other times the drill string is rotated as normal, which negates the action of the downhole motor bent housing on the drill bit.

In general, underreamers and bi-centre bits are not designed for high accuracy open hole directional drilling with steerable downhole motors or rotary steerable systems. Steerable drilling requires the drill bit which is utilised to be able to change the direction of the drilled well bore quickly when being tilted or a side force is applied. Underreamers have a large spacing between the pilot bit and the expandable arms and therefore do not permit this rapid directional change to take place. Bi-centre bits are designed such that the distance between the crown and offset pads is relatively large, and as a consequence these bits are not as steerable as ordinary short gauge bits.

It is recognised in the present invention that it would be an advantage to provide a truly expandable drill bit which is small enough such that it can be passed through a small diameter bore or casing in one mode and then can be expanded such that it can drill a larger diameter hole below the restriction it has passed through in a second mode, but wherein the drill bit is designed such that it has a sufficiently short gauge length to be used in a variety of drilling operations including steerable drilling applications.

It is therefore an object of the present invention to provide a truly expandable drill bit which can be used with steerable downhole motors or rotary steerable systems.

It is a further object of the present invention to provide an expandable drill bit which, when expanded, has a short gauge length and a crown profile with a shape common to solid crown bit, and therefore has the same steerability as conventional steerable solid crown drill bits.

According to the present invention there is provided an expandable drill bit for use with earth drilling equipment, wherein the drill bit is comprised of a body having two or more arms, the arms being provided by the crown of the drill bit having a split crown profile, wherein the arms support a plurality of cutting elements and are hingeably attached to the body, and wherein the arms are moveable between a first and second position, wherein the arms are closed in the first position and expanded in the second position.

Preferably, when the arms are in the second expanded position, the drill bit has a short gauge length and the profile of the expanded crown is similar to that of a steerable solid crown bit.

Preferably, movement of the arms from the first closed position to the second expanded position is provided by virtue of the movement of an actuating shaft.

In one preferred embodiment movement of the actuating shaft in a downward direction drives the arms from the first closed position to the second expanded position.

In an alternative embodiment, movement of the actuating shaft in an upward direction lifts the arms from the first closed position to the second expanded position.

The first embodiment is preferred as the actuating shaft can be used to support the arms to a greater degree. Also the bit nozzles can be placed closer to the cutters for greater hydraulic effect and the thrust area and hence the axial thrust acting on the actuating shaft to push the arms open can be made much greater, while minimising the overall length of the bit for greater steerability.

Preferably movement of the actuating member is driven by a hydrodynamic pressure drop.

Most preferably said hydrodynamic pressure drop is created by one or more nozzles which may be attached to the lowermost end of the actuating member.

Preferably the one or more nozzles communicate with a through bore defined by the actuating member.

Preferably the actuating member has an external upset at its lowermost end which supports the arms when closed in the first position, and drives the arms to the second expanded position upon the application of hydraulic pressure created by directing mud flowing through the ports or nozzles in the actuating member.

Preferably the arms have an internal profile which communicates with the upset end of the actuating member such that the upset end of the actuating member supports the arms both in the first closed position and in the second expanded position.

Preferably the drill bit is adapted for use with steerable drilling apparatus. The steerable drilling apparatus may include a downhole motor.

In one embodiment the arms are driven from the second expanded position to the first closed position by the action of return springs.

Optionally a first return spring is a heavy duty helical coil spring.

Alternatively a stack of disc springs can be utilised as the first return spring.

Preferably a second return spring comprises a single coil split ring.

Preferably the second return spring is located externally to the arms.

In a second embodiment the arms are pulled together from the second expanded position to the first closed position with the aid of both secondary return springs, wherein the springs are located internally to the arms.

Preferably the cutting elements comprise one or more rows of cutters on each arm.

Typically the cutters are made from a hard material such as diamond or tungsten carbide.

Preferably the cutters are arranged to form a double row of cutters in the centre of the bit, ie at least two of the arms overlap when in the closed position and when in the second expanded position the cutters will cut the full swept area out to the expanded gauge diameter.

Optionally the arms may include a sensor to detect if the arms are out to the gauge diameter intended. The sensor activation can also confirm that the arm is still in place, ie has not been torn off.

Preferably said sensor is in the form of an electrical switch to complete a circuit and one would preferably be used for each arm.

Optionally the drill bit may contain a sensor which registers the travel of the actuating shaft or the actuating shaft coupling.

Embodiments of the present invention will now be illustrated, by way of example, with reference to the following Figures in which.

Figure 1:
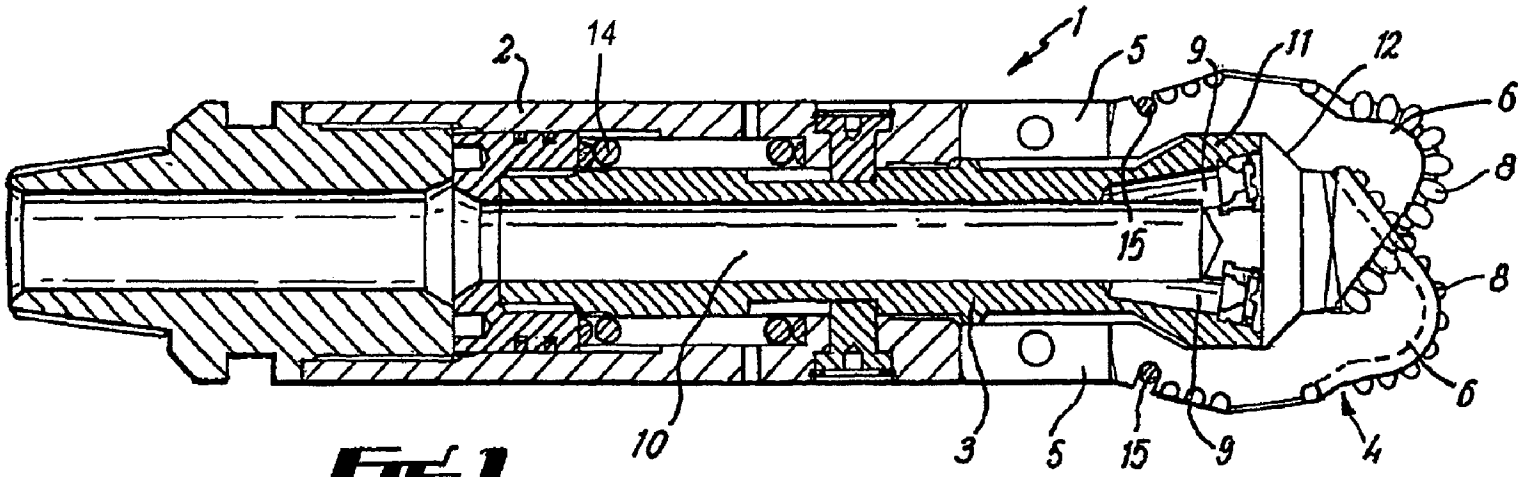
FIG. 1 illustrates an expandable drill bit in a closed configuration and in cross sectional detail in accordance with a first embodiment of the present invention.
Figure 3:
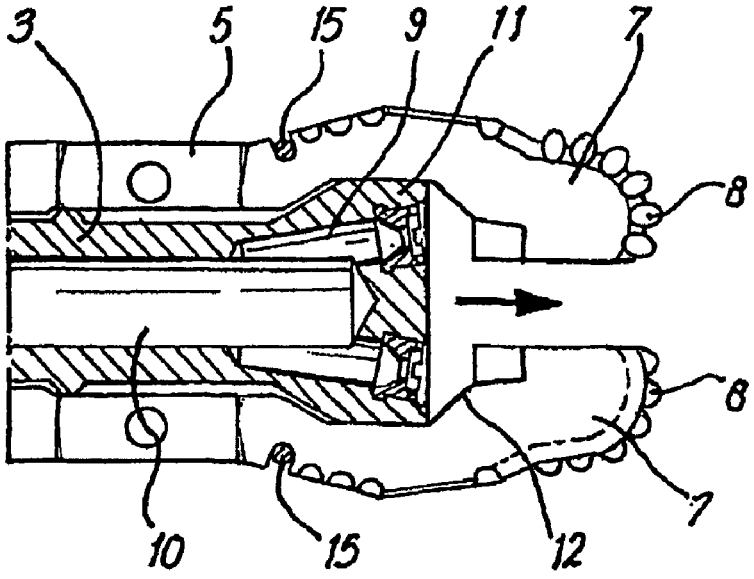
FIG. 3 illustrates the crown of the expandable drill bit in cross section, perpendicular to the view in FIG. 1.
Figure 4:
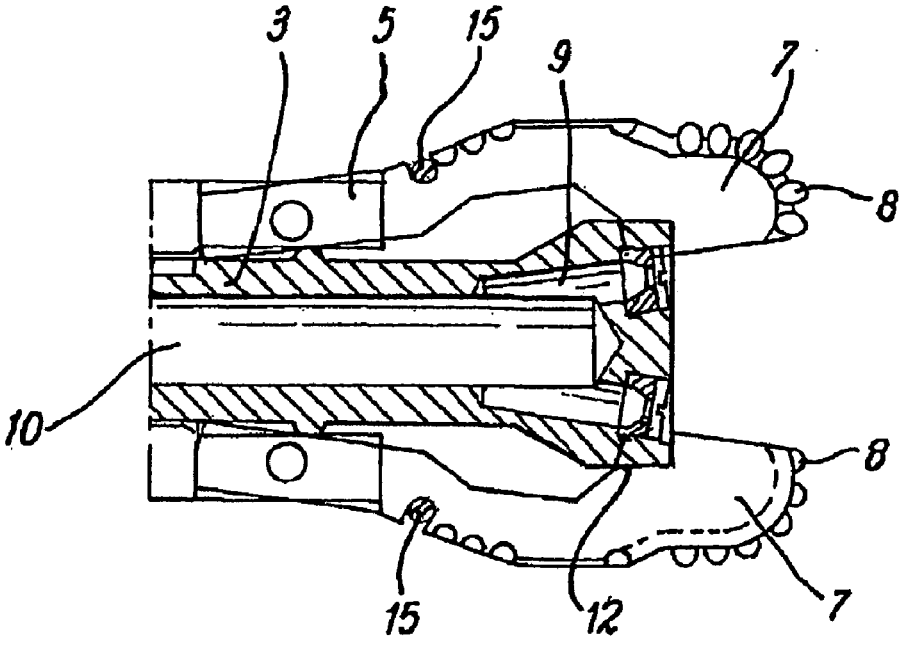
FIG. 4 illustrates the crown of the expandable drill bit in cross section, perpendicular to the view in FIG. 2.
Figure 5:
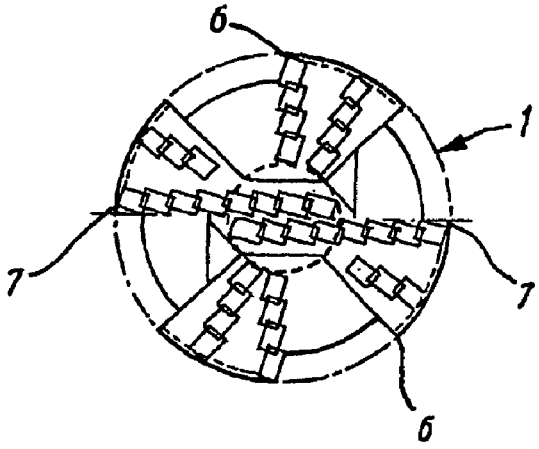
FIG. 5 illustrates an elevated view of the crown of the expandable drill bit in a closed configuration.

Referring firstly to FIG. 1, an expandable drill bit is depicted at 1 and is comprised of a generally cylindrical body 2, which can be attached to a work string (not shown) by either a pin or box threaded end connection, and an actuating member 3 shown as a shaft. The drill bit 1 also comprises four arms which are arranged as pairs and are formed as a result of the lowermost end of the drill bit 1 having a split crown profile 4, which can be seen from the elevated view of the bit 1 in FIGS. 5 and 6. More specifically, the split crown 4 comprises two pairs of segments or arms, each arm of which is attached to a hinge 5 which allows the arm to swing out from the body 2 of the bit 1. An individual hinge 5 with a pin inserted, can be seen in more detail in FIG. 7 upon which an individual arm of the drill bit 1 rests upon. In the cross sectional depiction of the drill bit in FIG. 1, one pair of arms 6 can be seen. A second pair of arms 7, as seen in FIGS. 3 and 4 extend perpendicularly to the pair of arms 6 shown in FIG. 1. The arms 6 and 7 are fitted with a plurality of cutting elements 8 made of a hard material, typically tungsten carbide or polycrystalline diamond which contact and drill the earth when the arms 6 and 7 are in an expanded configuration. However the arms 6 and 7 have an external profile such that when they are collapsed or closed into the body 2 of the bit 1, the cutting elements 8 do not ream the casing bore. Each arm 6 and 7 may carry a single or double row of cutters. The arms 6 and 7 may also be designed such that in the closed position shown in FIG. 5, there is a double row of cutters mounted back to back in the centre of the bit 1 to protect and supply a cutting action for drilling when the arms 6 and 7 are in a closed position. The arms 6 and 7 form a T shape around the hinge pin 5 area, which prevents them from being left downhole if the hinge pin 5 breaks.

Nozzles 9 are attached to the lowermost end of the actuating shaft 3 and communicate with a fluid through bore 10 which is defined by the body of the actuating shaft 3. The nozzles 9 may be permanently or detachably fixed to the actuating shaft 3 to allow the jetting of drilling fluid. In the depicted embodiment a total of four nozzles 9 are fitted to the actuating shaft 3 although it is recognised that the number of nozzles 9 which can be fitted is not limited, and is restricted only by the space constraints of the size of the actuating shaft 3. The nozzles 9 are used for standard jetting of the bit face when drilling, to remove any cutting build up which may gather immediately in front of the actuating member 3 and arms 6 and 7, and also to supply a hydraulic pressure drop which moves the actuating shaft 3.

Figure 2:
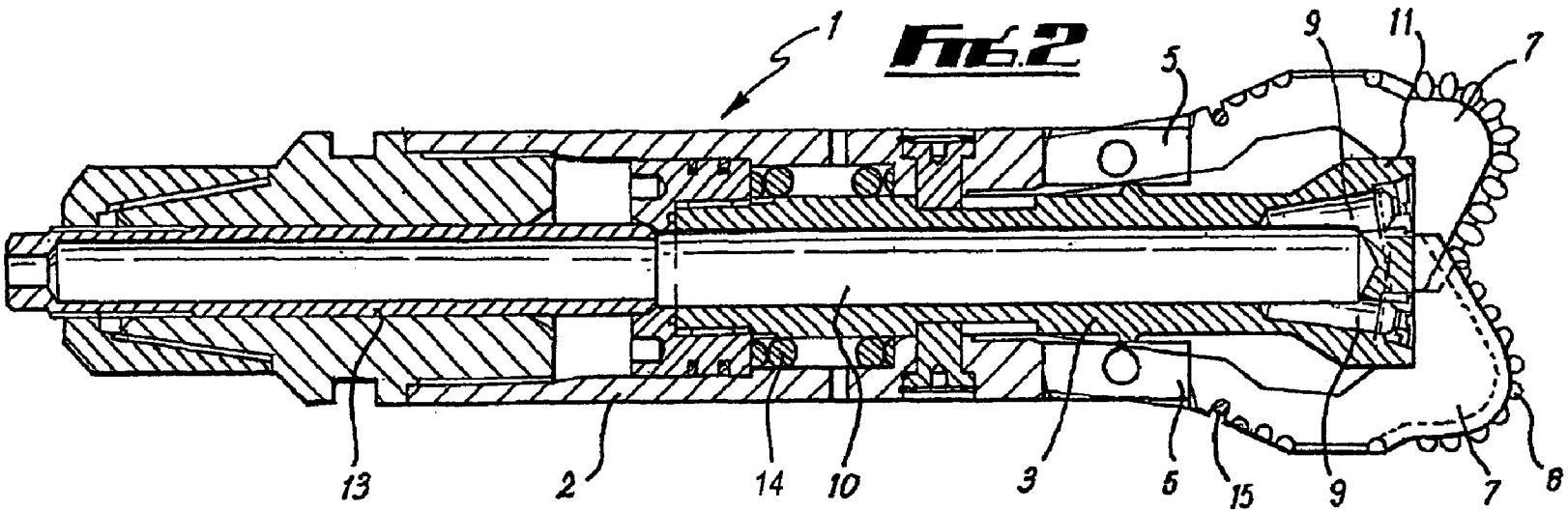
FIG. 2 illustrates the expandable drill bit of FIG. 1 in an expanded configuration in cross sectional detail.

The arms 6 and 7 of the drill bit 1 can move between a first position shown in FIG. 1 wherein they are closed against the body 2 of the drill bit 1, and a second position shown in FIG. 2 wherein they are expanded away from the body 2. Movement of the arms 6 and 7 from the first closed to the second expanded position occurs when a pressure drop is created across the assembly of nozzles 9, thereby moving the actuating shaft 3 downwards. The actuating shaft 3 drives the arms 6 and 7 outwards to their gauge stop position and acts to support and reinforce the arms 6 and 7 and hinge pins 5. It will be seen from FIGS. 1 to 4 that the lowermost end of the actuating member 3, that is the end nearest to the crown of the drill bit 1, has an external upset 11. The arms 6 and 7 have a corresponding internal profile 12 which communicates with the upset end 11 of the actuating member 3 (FIGS. 3 and 4). When it is desirable for the arms 6 and 7 to be expanded (FIG. 4), fluid is passed into the actuating shaft 3 through bore 10 and through the nozzles 9 creating a sufficient hydrodynamic pressure drop to move the actuating shaft 3 in a downward direction. As a result the upset end 11 of the actuating member 3 will move down in the direction of the arrow shown in FIG. 3 to communicate with a corresponding shoulder located in the internal profile 12 of the arms 4 as seen in FIG. 4, thereby driving the arms 6 and 7 outwards into the second expanded position. The actuating member 3 supports the arms 6 and 7 when expanded, from the inward force which is impacted on them by the walls of the bore. In order to retain the arms 6 and 7 in the closed position, the flow rate through the nozzles 9 is minimised in order to keep the hydrodynamic pressure below that which is required to drive the actuating shaft 3 in a downwards direction to expand the arms 6 and 7. A shear pin may also be incorporated into the bit 1 between each arms 6 and 7 and the actuating shaft 3 or between the actuating shaft 3 and the body 2.

In the described embodiment the hydrodynamic pressure drop causes the actuating member 3 to move in a downward direction where it engages with an internal profile shoulder 12 on the arms 6 and 7 to expand them outwardly from the body 2 of the drill bit 1. However it is recognised that in an alternative embodiment of the present invention the actuating shaft 3 may be adapted to be driven in an upward direction by the pressure drop, wherein upon moving upwards, the actuating member 3 lifts the arms 6 and 7 into an expanded open configuration.

The actuating shaft 3 is prevented from rotating with respect to the body 2 by four (by way of example) pins so that the nose of the actuating shaft will strengthen the four arms when torque is applied to them. A spline could also be used. The nose of the actuating shaft 3 has a milled profile to support the arms with respect to torque applied when drilling.

The back of the arms 6 and 7 is designed such that it has a low angle with respect to the hole diameter. This allows maximum force to be applied in the event that the arms 6 and 7 stick in the second expanded position so that when the drill bit 1 is pulled up against the casing shoe(not shown) the arms 6 and 7 will be driven back against the body 2 of the drill bit 1 with maximum force. This tapered surface could also have cutters fitted for back-reaming when pulling out of hole.

It will be appreciated that at some point prior to running the apparatus it may be necessary to check the size of the nozzles 9 in order to determine whether they suit the required downhole hydraulics for the run. In the preferred embodiment the drill bit 1 will be nozzled such that the arms 6 and 7 begin to extend at a minimum hydrodynamic pressure of approximately 100 psi and be fully expanded by 200 psi, although it will be appreciated that these pressures could be varied for the particular drilling application and conditions. This allows a minimum circulation to be run through the bit 1 for lubrication, without expanding the arms 6 and 7.

Figure 6:
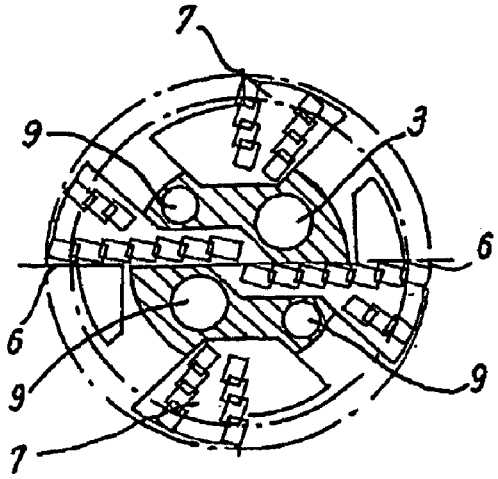
FIG. 6 is an elevated view of the crown of the expandable drill bit in an expanded configuration.
Figure 7:
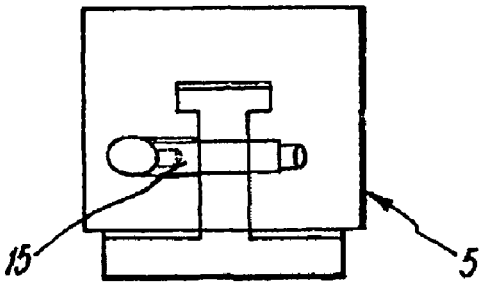
FIGS. 7 and 8 illustrate the hinge upon which the arms of the expandable drill bit are mounted.

In order to change the nozzles 9 prior to use, a threaded rod 13 already screwed into a coupling is inserted into the fluid through bore 10 of the drill bit 1, as can be seen in FIG. 2. The coupling is screwed onto the drill bit 1, typically onto the inlet pin or box thread which connects the drill bit 1 to a work string (not shown) in use. The actuating shaft 3 can then be driven downwards by rotating the threaded rod 13 into the coupling in order to drive the arms 6 and 7 away from the body 2, permitting access to the nozzles 9 which are located between the arms 6 and 7 on the expanded face of the bit 1 (FIG. 6). The nozzles 9 can be removed and replaced using a standard bit nozzle spanner (not shown).

In order to allow the drill bit 1 to pass through restrictions, such as a narrow diameter bore or in-place casing, it is necessary for the arms 6 and 7 of the drill bit 1 to be closed. This is achieved by way of two springs which drive the arms 6 and 7 back into the body 2. The first spring 14 is an internal heavy duty helical coil spring whilst the second is a single coil split ring 15 which is mounted around the outside of the four arms 6 and 7, in the area just outside the hinge pins 5. The second spring 15 adds a more positive return force directly to the arms 6 and 7 when the actuating member 3 returns to the position shown in FIG. 3.

It is recognised that although the springs are located external to the arms 6 and 7 in the described embodiment, in an alternative embodiment two or more springs could be used on the inside of the arms 6 and 7 which pull them together. Further, the first spring could alternatively be a stack of disc springs.

Figure 8:
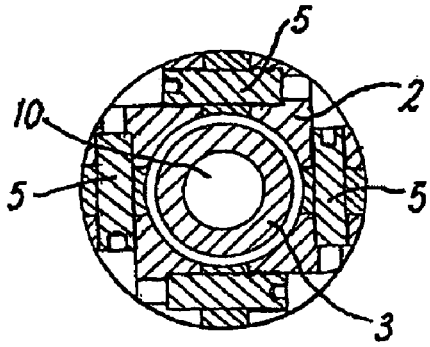

FIG. 8 illustrates a sectional view through the hinge section of the drill bit 1. In FIG. 8 four hinges 5, can be seen in position around the actuating shaft 3.

The hinges 5 are positioned between the body 2 of the tool and the arms (not shown), each arm being attached to a hinge 5 which allows the arm to expand away from the body 2 upon movement of the actuating shaft 3.

Note also that each pair of arms could be linked via a guide pin with one of the arms having a pin rigidly fitted with a slot in the adjacent mating arm.

The drill bit 1 also preferably comprises low friction piston seals which may be PTFE seals with O ring energisers, between the body 2 and the shaft 3, which minimise the force available from the coil spring 15 to return the actuating shaft 3. In a preferred embodiment the bore 10 of the body 2 has a corrosion resistant coating or treatment so that the seals run on a smooth surface.

Figure 9:
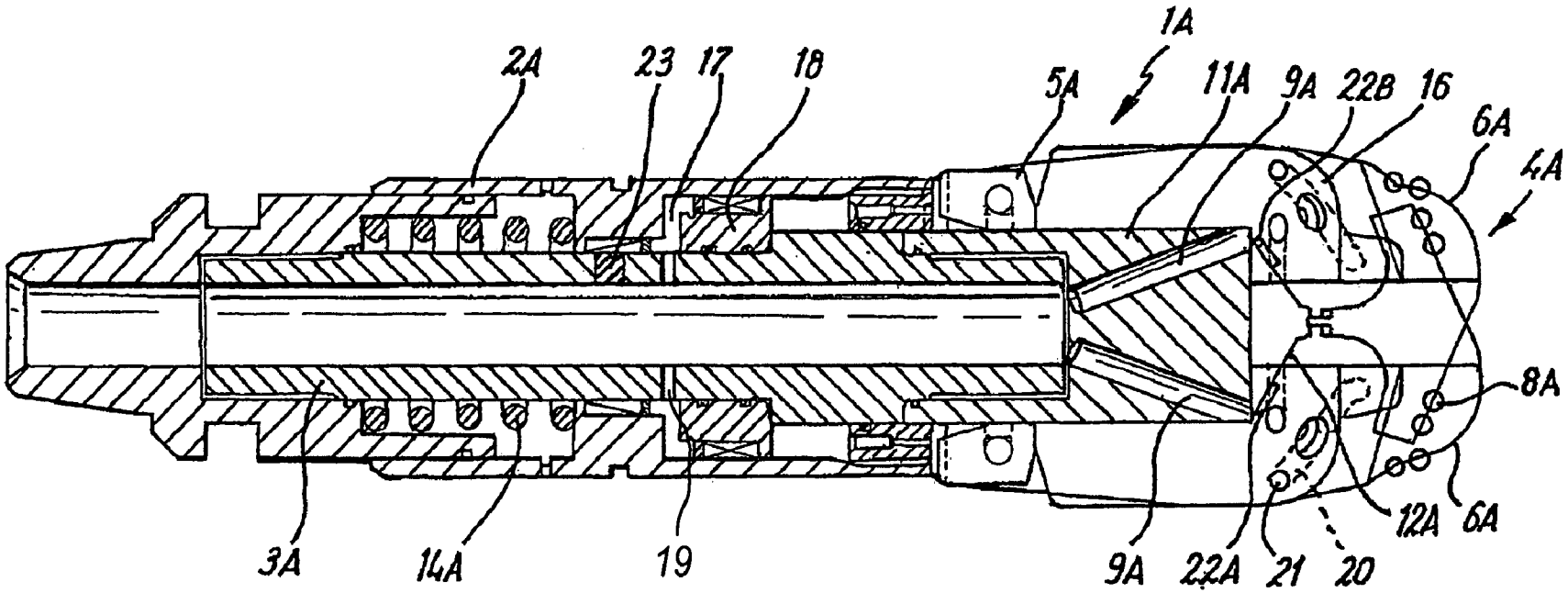
FIG. 9 illustrates an expandable drill bit in a closed configuration and in cross-sectional detail in accordance with a second embodiment of the present invention.
Figure 10:
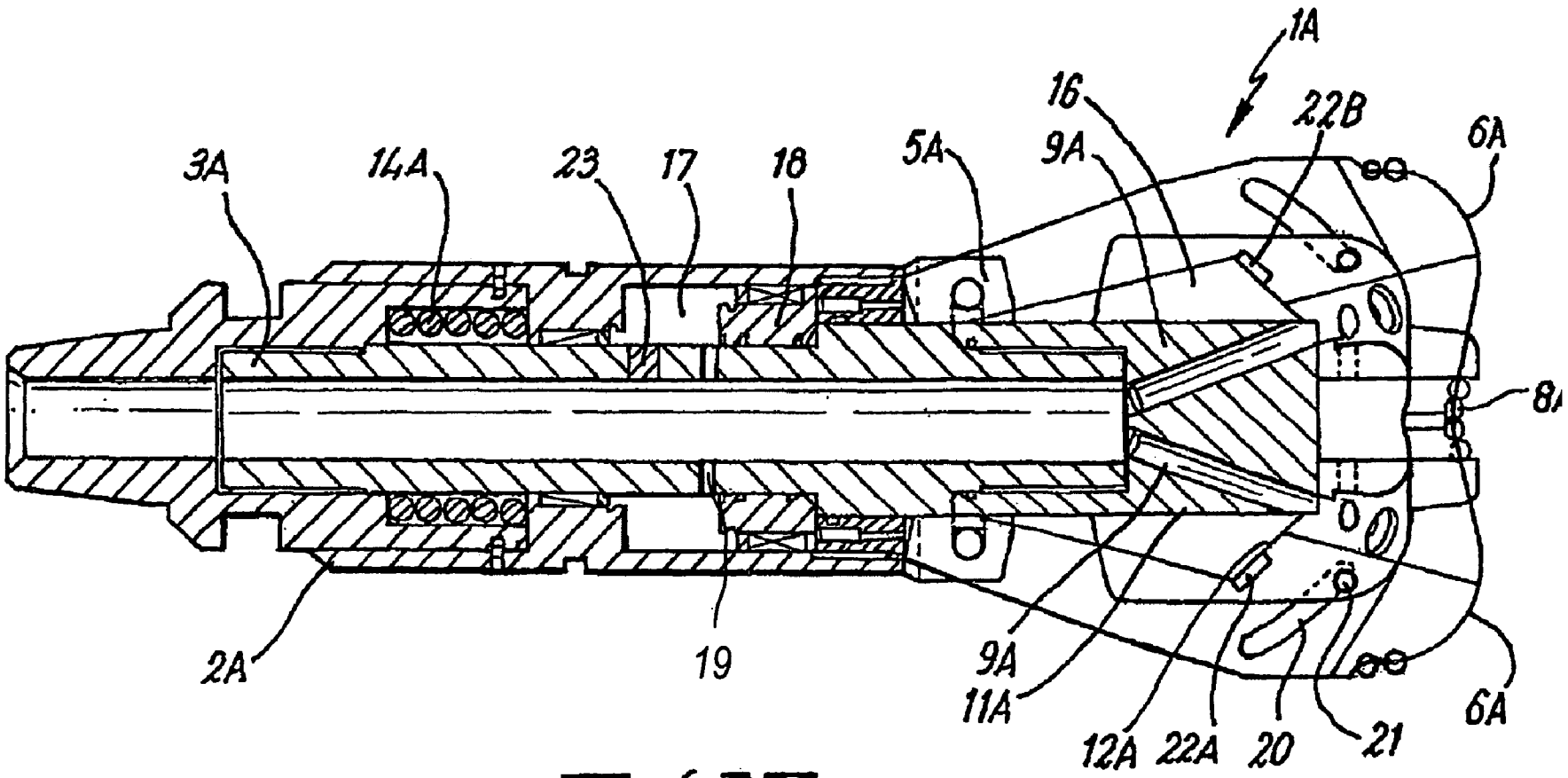
FIG. 10 illustrates the expandable drill bit of FIG. 9 in an expanded configuration and in cross-sectional detail.

FIGS. 9 and 10 illustrate an expandable drill bit according to a second embodiment of the present invention. Like parts to those of the first embodiment shown in FIGS. 1 through 8 are given the same reference numerals, but are suffixed "A".

Expandable bit 1A is now such that the drilling load applied to the bit is taken entirely through the inner mandrel/actuating shaft 3A. This means that the application of drilling weight to the bit now keeps the arms 6A, 7A in the expanded position in addition to the hydraulic force acting on an internal piston 18.

The tool 1A is hydraulically actuated due to the pressure drop created by throttling the flow of drilling fluid by the nozzles 9A in the head 16 of the bit. Simply applying drilling weight to the tool 1A in the closed position would also tend to expand the arms 6A, 7A, but is not a principal operating feature.

Internal hydraulic pressure is applied to the chamber 17 above the piston 18 mounted on the inner mandrel 3A by means of radial drilled holes 19 in the mandrel 3A. The force created moves the outer cylinder 2A axially upwards, compressing the spring 14A and drawing the arms 6A, 7A upwards over the profile of the head 16 into the expanded position.

The arms 6A, 7A are now constrained within slots 20 in the head for greater rigidity. Guide pins 21 act on slots 20 machined in the arms 6A, 7A to ensure that the arms 6A, 7A return to the closed position on removal of the pressure differential, as described hereinbefore. Note that a secondary spring is no longer used to close the arms 6A, 7A.

An additional feature of the second embodiment of bit 1A is that pulling upwards on the tool 1A will tend to drag the external sleeve 2A downwards, thus moving the arms 6A, 7A to the closed position.

A further feature of the second embodiment of bit 1A includes two sensors 22, 23.

Arms 6A and 7A are fitted with sensors 22A-D. Sensors 22A-D are electronic sensors, which signal when the arms 6A and 7A are out at gauge size. This signal is sent back into an MWD tool behind the bit 1A or may be an instrumented downhole motor, and then transmitted directly to the surface, so that the operator is aware of the configuration of the bit 1A as it is run downhole. The sensors 22A-D being activated would also confirm the arms 6A and 7A are still in position ie have not been torn off. Sensor 23 is also fitted to bit 1A. Sensor 23 registers the movement of the actuating shaft 3A.

The advantage of the present invention over the prior art is that there is provided a truly expandable drill bit, in contrast to an offset bi-centre bit or an underreamer for use in conjunction with a standard drill bit. The expandable drill bit is therefore characterised in that it has all the proven characteristics of a standard steerable drill bit, most notably a short gauge length with a standard crown profile shape and can be used with steerable drilling apparatus, but also has a variable diameter which facilitates the passage of the drill bit through an area of a well bore or casing with a restricted diameter in order to drill a section of bore with a greater diameter, below the restricted area.

Further modifications and improvements may be incorporated without departing from the scope of the invention herein intended.

The invention claimed is:

1. An expandable drill bit comprising:

a body having a bore formed therein;

at least two arms attached to the body, the at least two arms movable between a closed position and an expanded position, the arms including a plurality of cutting elements on an outer surface thereof from a centerline of the bit to an outer diameter of the bit in each position, the plurality of cutting elements on the arms being capable of drilling a bore from a centerline of the bore to an outside diameter of the bore at one time upon rotation with the arms in both the closed position and the open position; and an actuating shaft disposed in the bore, the shaft configurable to move the at least two arms between the closed position and the expanded position, wherein the shaft is movable between a first position and a second position relative to the body.

2. The drill bit of claim 1, wherein the cutting elements form a double row of cutters when the arms are in the closed position.

3. The drill bit of claim 1, wherein the drill bit is adapted for use with a steerable drilling apparatus.

4. The drill bit of claim 1, wherein the actuating shaft moves in a downward direction to move the arms to the expanded position.

5. The drill bit of claim 1, wherein the actuating shaft moves in an upward direction to move the arms to the expanded position.

6. The drill bit of claim 1, wherein the actuating shaft is driven by a hydrodynamic pressure drop created by one or more nozzles formed in the actuating shaft.

7. The drill bit of claim 6, wherein the actuating shaft has an external upset which supports the arms when in the closed position, and drives the arms to the expanded position upon application of hydraulic pressure created by directing mud through the nozzles in the actuating shaft.

8. The drill bit of claim 7, wherein the arms have an internal profile which communicates with the external upset end of the actuating shaft and the external upset end supports the arms in both the closed position and the expanded position.

9. The drill bit of claim 1, wherein the arms have a sensor which detects gauge diameter.

10. The drill bit of claim 9, wherein the sensor is at least one electrical switch to complete a circuit in each arm.

11. The drill bit of claim 1, wherein the drill bit contains a sensor which registers the travel of the actuating shaft.

12. The drill bit of claim 1, wherein one or more shear pins keep the arms in the closed position until the actuating shaft is activated.

13. An expandable drill bit for use with earth drilling equipment, the drill bit comprising:

a body having two or more arms, the arms being provided by the crown of the drill bit having a split crown profile, the arms support a plurality of cutting elements and are hingeably attached to the body and the arms are moveable between a first closed position and second open position, the arms are driven from the second expanded position to the first closed position by the action of return springs, wherein one return spring comprises a single coil split ring disposed around an external surface of the arms.

14. The expandable drill bit as claimed in claim 13, wherein the drill bit is capable of drilling a complete swept bore in the earth with the arms in both the first closed position and the second open position.

15. An expandable drill bit for use with earth drilling equipment, the drill bit comprising:

a body having two or more arms, the arms being provided by the crown of the drill bit having a split crown profile, the arms support a plurality of cutting elements and are hingeably attached to the body and the arms are moveable between a first closed position and second open position, wherein the arms include a sensor to detect if the arms are out to the gauge diameter intended and the sensor is in the form of at least one electrical switch to complete a circuit in each arm.

16. An expandable drill bit for use with earth drilling equipment, the drill bit comprising:

a body having one or more arms hingeably attached thereto, the arms support a plurality of cutting elements and the arms being moveable around a pivot point between a first closed position and second open position, wherein the cutting elements are disposed on the arms from a centerline of the drill bit to an outside diameter of the drill bit in both the first closed position and the second open position; and a fluid operated opening member configured to move the arms between the closed position and the open position.

17. The expandable drill bit of claim 16, wherein the fluid operated opening member is a piston area.

18. An expandable drill bit for use in forming a borehole, the drill bit comprising:

a body;

at least two arms attached to the body, the at least two arms movable between a closed position and an expanded position, each arm having a plurality of cutting elements on an outer surface thereof, whereby in the closed position the cutting elements on one arm cross over a centerline of the bit and overlap cutters of the other arm and in the open position the cutting elements extend at least from the centerline of the bit and beyond an outer diameter of the body; and a fluid operated opening member configured to move the arms between the closed position and the open position.

19. The expandable bit of claim 18, wherein the cutting elements are fixed to the arms.

20. The expandable bit of claim 18, wherein the bit is configured to have a crown profile when the arms are in the expanded position.

21. The expandable drill bit of claim 18, wherein the fluid operated opening member is a piston area.

22. An expandable drill bit comprising:

a body having a bore formed therein;

at least two arms attached to the body, the at least two arms movable between a closed position and an expanded position, the arms including a plurality of cutting elements on an outer surface thereof from a centerline of the bit to an outer diameter of the bit in each position, the plurality of cutting elements on the arms being capable of drilling a bore from a centerline of the bore to an outside diameter of the bore at one time upon rotation with the arms in both the closed position and the open position, wherein the arms are driven from the expanded position to the closed position by return springs; and an actuating shaft disposed in the bore, the shaft configurable to move the at least two arms between the closed position and the expanded position.

23. The drill bit of claim 22, wherein at least one return spring comprises a single coil split ring.

24. The drill bit of claim 23, wherein a second return spring is located externally to the arms.

* * * * *